US005443000A

United States Patent [19]

Wenzel

[11] Patent Number: 5,443,000

[45] Date of Patent: Aug. 22, 1995

[54] CALENDER

[75] Inventor: Reinhard Wenzel, Krefeld, Germany

[73] Assignee: Sulzer Papertec Krefeld GmbH, Krefeld, Germany

[21] Appl. No.: 234,984

[22] Filed: Apr. 28, 1994

[30] Foreign Application Priority Data

May 4, 1993 [DE] Germany ..... 43 14 670.8

[51] Int. Cl.[6] ..... B30B 3/04; D21G 1/02

[52] U.S. Cl. ..... 100/163 A; 100/168; 100/170

[58] Field of Search ..... 100/161, 162 R, 163 R, 100/164, 165, 168, 169, 170; 72/232, 234

[56] References Cited

U.S. PATENT DOCUMENTS

| | | | |
|---|---|---|---|
| 3,373,681 | 3/1968 | Jaegers | 100/163 R |
| 3,584,570 | 6/1971 | Sass et al. | 100/163 R |
| 3,777,656 | 12/1973 | Müller | 100/163 A |
| 3,942,434 | 3/1976 | Wenzel et al. | 100/168 |
| 3,948,166 | 4/1976 | Wenzel | 100/163 R |
| 4,380,954 | 4/1983 | Edele | 100/170 |
| 4,434,713 | 3/1984 | Hartwich et al. | 100/168 |
| 5,038,678 | 8/1991 | Honkala et al. | 100/163 A |

FOREIGN PATENT DOCUMENTS

| | | |
|---|---|---|
| 2731119 | 1/1979 | Germany . |
| 2440688 | 11/1979 | Germany . |
| 2415836C3 | 6/1982 | Germany . |
| 2224875C3 | 3/1983 | Germany . |

*Primary Examiner*—Stephen F. Gerrity
*Attorney, Agent, or Firm*—Darby & Darby

[57] ABSTRACT

A calender arrangement having vertically-arranged upper, center and lower rollers with matching upper, center and lower carrier-blocks and a suspended spindle, comprises a support element above a bearing-surface on the upper carrier-block. The support-element aids in lifting the suspended spindle and a carrier-nut when raising the upper carrier-block. An insert is placed between a bearing-surface on the upper carrier-block and the support-element, which comprises a horizontal slider seated on the upper carrier-block, which enables a relatively small motor to be used to reset the carrier-nut.

6 Claims, 3 Drawing Sheets

CALENDER

FIELD OF THE INVENTION

The present invention relates generally to a calender having a vertical roller arrangement with matching carrier-blocks for improved roller separation, and more particularly to a calender having a suspended spindle and an upright slide for engaging upper, center and lower carder-blocks having corresponding upper, center and lower rollers, wherein the carrier-blocks of at least the lower and center rollers are vertically movable along the upright slide. The suspended spindle has threaded sections that threadably engage height-adjustable support-elements for supporting the carrier-blocks during roller separation. A motorized, adjustable carrier-nut is operatively attached to the upper end of the suspended spindle and supported on a stop, while an elevating-device is operatively attached to the lower roller, thereby facilitating the roller movement and allowing the carder-blocks to be lifted.

BACKGROUND OF THE INVENTION

Conventional calenders such as that described in DE-OS 27 31 119, Kayser et al., issued Jan. 25, 1979, typically comprise a vertical roller arrangement with matching, vertically-movable carrier-blocks. During adjustment, the carrier-block of the upper roller is supported by the piston of a hydraulic cylinder, while the lower roller is moved into and out of an operating position for roller separation by positioning nut-shaped support-elements on a suspended spindle. The roller separation is facilitated by an elevating-device, which has two hydraulic cylinders engaged with the upper and lower carder-blocks.

The suspended spindle is fastened to the carrier-block of the upper roller at the upper end of the roller arrangement and is provided with a carrier-nut that can be rotated by a motor. The carder-nut functions only when the rollers are retracted, thereby either resting on a bearing-surface of the upper carder-block or on an insert attached to the beating surface. However, by using this roller adjustment configuration, the rollers are strained by the weight of the suspended spindle.

Another conventional calender is described in DE-PS 22 24 875, Müiller et al., issued Dec. 13, 1973, wherein the carder-nut rests on a register of the upper carrier-block during adjustment. Through rotation, actuated by a motor, the height of the entire suspended spindle and support-elements can be reset. In addition, by using a brake to secure the carder-nut against rotation, the height of the carder-nut does not reset. However, as with the Kayser adjustment configuration, the rollers in the Müller configuration are also strained by the weight of the suspended spindle.

It would be desirable to use a combination of both roller adjustment configurations, where the rollers are not strained by the weight of the suspended spindle. Therefore, an improvement to the prior art would be to provide a calender having a combination of the above roller adjustment configurations, wherein the weight of the suspended spindle is lifted so that the rollers are not strained and the carder-nut is driven by a relatively small motor.

SUMMARY OF THE INVENTION

The present invention provides a calender having rollers and matching carrier-blocks, vertically-arranged in a stand, wherein the rollers are not strained by the weight of the suspended spindle as the weight is supported in the operating position by a carrier-nut positioned on a stop. The weight of the suspended spindle, which could be as much as 33.72 k-lbs (150 kN), is transferred directly to the stand in the operating position and not to the rollers. An insert is provided between a beating surface on the upper-most carrier-block and a primary support-element, wherein the insert has a thickness which allows the suspended spindle and carder-nut to be lifted during elevation of the upper-most carder-block. By using the insert, rotation of the carrier-nut requires little force, which may be provided by a relatively small motor. However, without the insert, the calender functions in the conventional manner, requiring an enormous force to rotate the carrier-nut. In addition, the calender may utilize an insert in the form of a horizontal slider, which is supported on the upper-most carrier-block and operated by an actuator (e.g., a pneumatic or hydraulic piston).

It is also advantageous that the primary support-element be positioned relatively high on the suspended spindle, above the upper-most carrier-block, which results in a shorter free-length of the suspended spindle, thereby reducing the danger of lateral bending.

In a preferred design, the upper roller can be loaded through an energizer. The upper roller is seated in a sliding carrier-block having a bearing-surface, wherein a support-element can be positioned at a relatively small distance below the carrier-nut.

It is beneficial to have the upper and lower rollers seated in the matching carrier-blocks. Thus, adjusting the rollers also adjusts the matching carrier-blocks.

It is also advantageous to have the center rollers seated in the matching bearing-blocks and flexibly linked to the carder-blocks by levers, wherein the carrier-blocks are provided with stops to engage the levers.

DETAILED DESCRIPTION OF THE INVENTION

Figure 1:
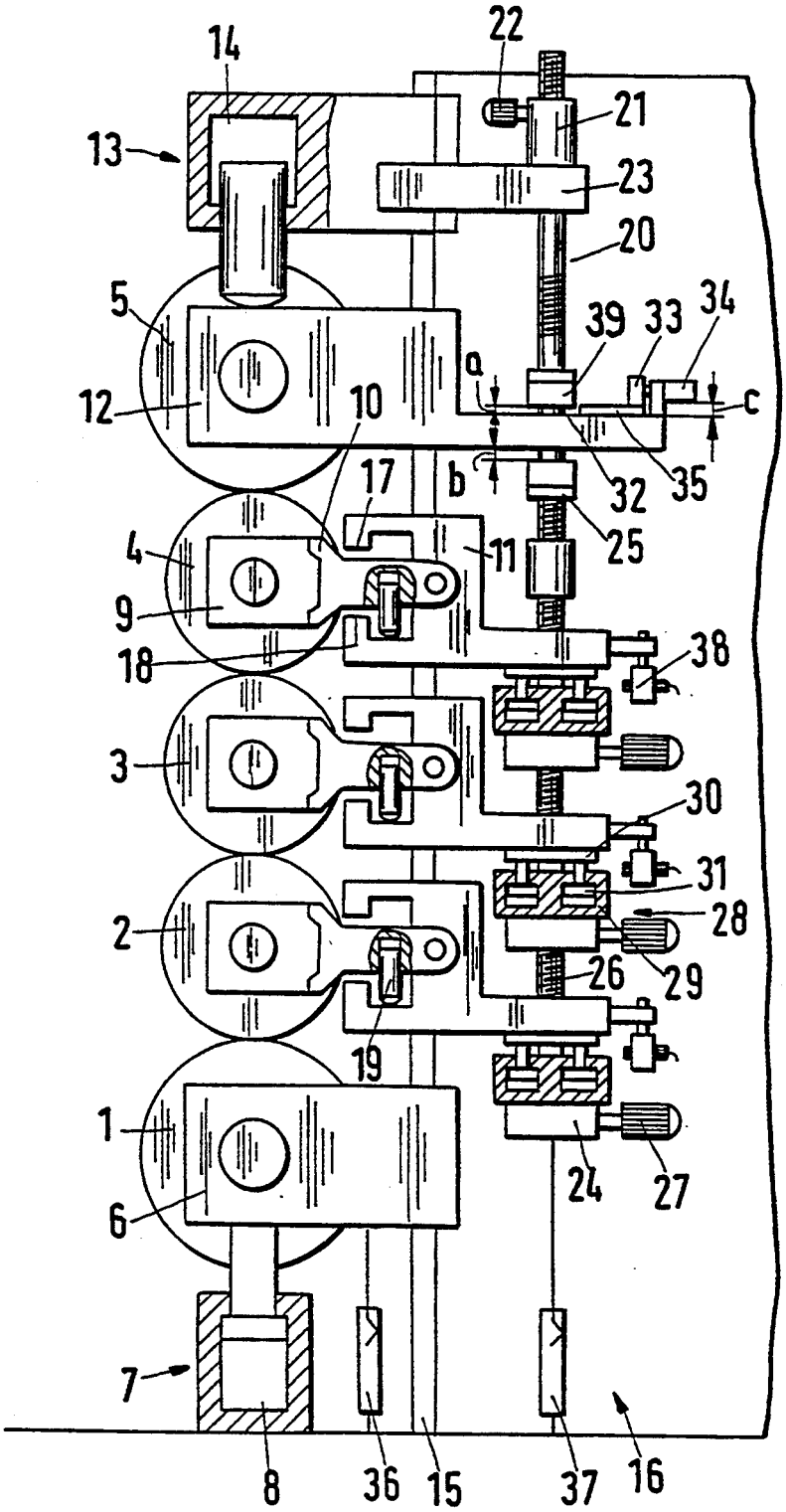
FIG. 1 is a side view of the calender in an operating position according to the preferred embodiment of the present invention.
Figure 2:
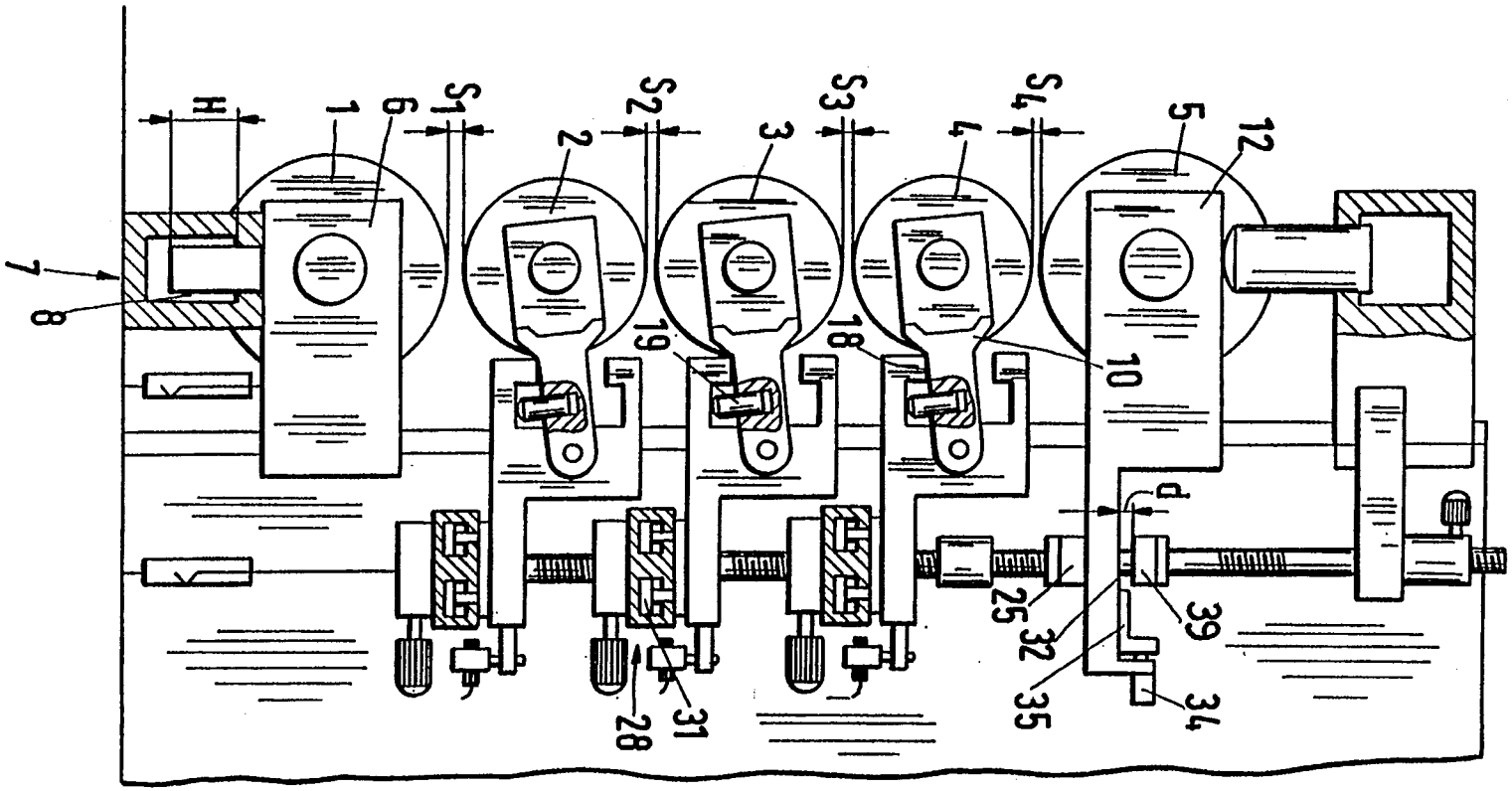
FIG. 2 is a side view of the calender of FIG. 1 having separated rollers according to the preferred embodiment of the present invention.

Referring to FIGS. 1 and 2, a preferred calender has a vertical roller arrangement configured in a stand 16, wherein a lower roller 1, three center rollers 2, 3, 4 and an upper roller 5 engage an upright slide 15 with matching carrier-blocks 6, 11, 12, respectively. Lower roller 1 is seated in carrier-block 6 at the lower end of stand 16. By using an elevating-device 7, lower roller 1 is raised to an operating position (FIG. 1) and lower to a resting position (FIG. 2). Elevating-device 7 is driven by the piston of a hydraulic cylinder 8, which engages carrier-block 6. Center rollers 2, 3, 4 are seated in bearing-blocks 9, which are connected to carrier-blocks 11 and swivel by levers 10. Upper roller 5 is seated in carrier-block 12 at the upper end of stand 16 and is lowered to the operating position (FIG. I) by an energizer 13, which is driven by the piston of a hydraulic cylinder 14.

Carrier-blocks 6, 11, 12 move vertically along upright slide 15 of stand 16. Therefore, carrier-block 12 is vertically guided along slide 15 as energizer 13 is activated.

Carrier-blocks 11 have upper stops 17 and lower stops 18, which are engaged by either an upward or downward movement of center rollers 2, 3, 4 with the appropriate lever 10. Hydraulic cylinders 19 operate between levers 10 and carrier-blocks 11, thereby compensating for undesirable forces from the overhanging weight of the rollers and carrier-blocks.

A suspended spindle 20 and a carrier-nut 21 are provided at the upper end of stand 16. Carrier-nut 21 is supported by a stop or register 23 and can be rotated by a motor 22 which enables the height of suspended spindle 20 to be adjusted. A support-element 25 is formed as a threaded nut on suspended spindle 20 and supports carrier-block 12 of upper roller 5. Support-elements 24 engage threaded sections 26 of suspended spindle 20 and support carrier-blocks 11 of center rollers 2, 3, 4. Support-elements 24 are tightly connected with threaded sections 26 of suspended spindle 20 and can be rotated by a motor 27, as is known from DE-PS 24 15 836.

A positioning-device 28 is installed between each support-element 24 and matching carrier-block 11. Positioning-device 28 consists of a lower base 29 and an upper plate 30, which can be pushed upward by the pistons of hydraulic cylinders 31 as is known from DE-PS 24 40 688.

On the upper portion of suspended spindle 20 is a primary support-element 39, which functions as a nut and corresponding counter-nut. Support-element 39 is positioned above a bearing-surface 32, located on carrier-block 12. A horizontal-slider 33 and a fork-shaped insert 35 are placed between support-element 39 and bearing surface 32 and moved by an actuator 34. During adjustment, position-indicators 36, 37, 38 indicate the height of carrier-block 6, lower support-element 24 and base 29, respectively, of suspended spindle 20 with respect to carrier-blocks 11.

In operation (FIG. 1), the upward movement of the piston of hydraulic cylinder 8 drives carder-block 6 of lower roller 1 upward, thereby engaging center rollers 2, 3, 4 and upper roller 5, respectively. During engagement, levers 10 move freely between stops 17, 18. When activated, hydraulic cylinders 19 and positioning-devices 28 compensate for the overhanging weight of the rollers, wherein the distance between support-element 39 and beating-surface 32, carder-block 12 and support-element 25 and the thickness of insert 35 are represented by "a ", "b" and "c", respectively.

Figure 3:
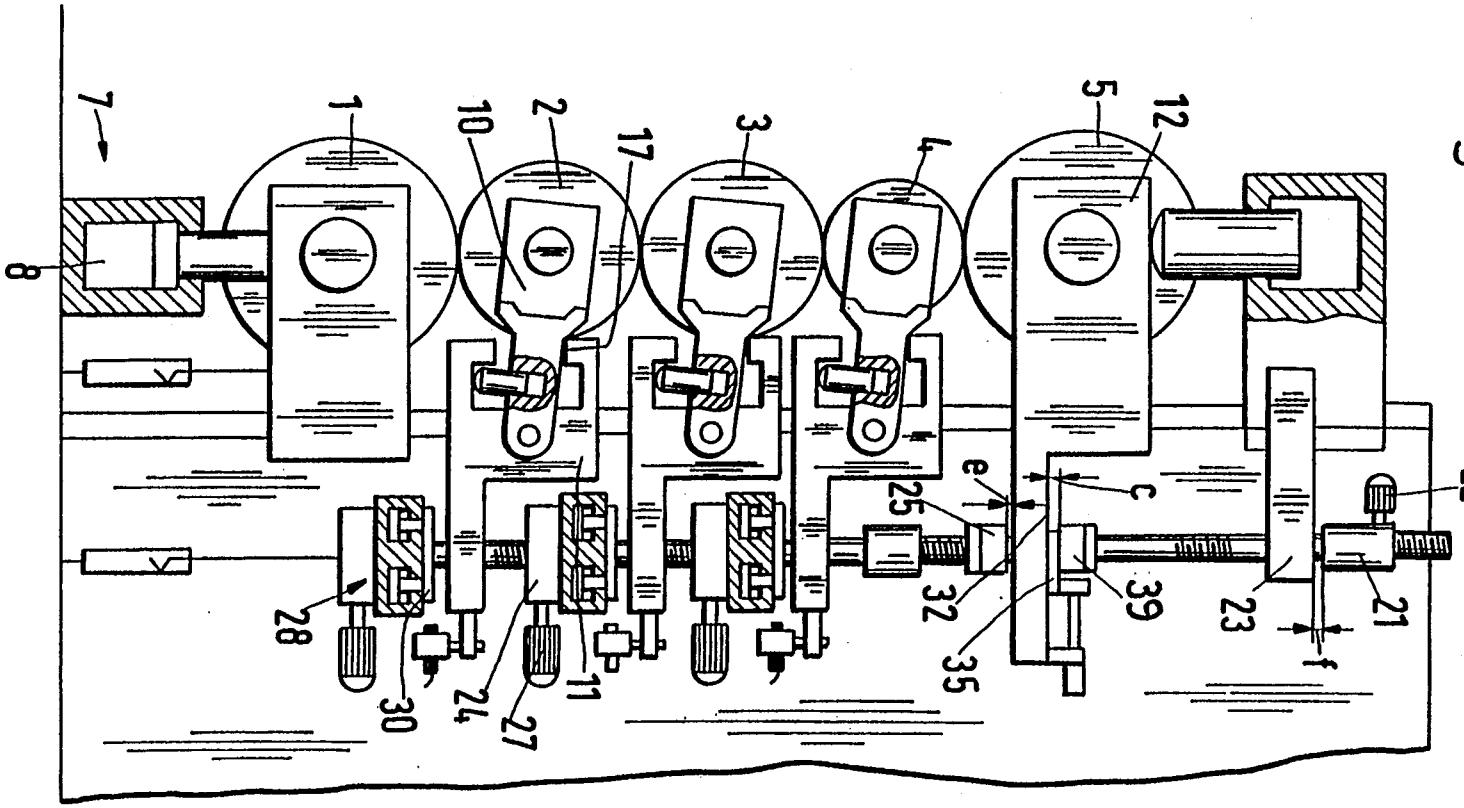
FIG. 3 is a side view of the calender of FIGS. 1 and 2 having a raised suspended spindle according to the preferred embodiment of the present invention.

Separation of rollers 1–5 (FIG. 2) is achieved when hydraulic cylinders 8, 19 and 31 are deactivated. The piston of hydraulic cylinder 8 drops by a distance "H" and center rollers 2, 3, 4 drop until levers 10 are engaged with stops 18. Thus, positioning-devices 28 assume their minimum height. Carder-block 12 of upper roller 5 drops to engage support-element 25, whereby rollers 1–5 are now at a distance $S_1$, $S_2$, $S_3$ and $S_4$ relative to one another. The distance between support-element 39 and beating-surface 32 assumes the value represented by "d", wherein the formula $a+b=d>c$ applies. In this position, insert 35 is moved by actuator 34 between support-element 39 and bearing-surface 32 (FIG. 3).

As elevating-device 7 is reactivated to place hydraulic cylinder 8 under pressure, roller-spaces $S_1$, $S_2$, $S_3$ and $S_4$ will close and rollers 1–5 will be forced upward. In doing so, levers 10 will be pushed up against upper stops 17 of carder-blocks 11, whereby levers 10 will be raised upward from plates 30 of positioning-devices 28. Carder-block 12 of upper roller 5 is also raised upward from support-element 25. Simultaneously, carrier-nut 21 is lifted from register 23 and can then be easily rotated by motor 22. When the distance between carder-block 12 and support-element 25, carrier-nut 21 and register 23, and the thickness of insert 35 have the values shown at "e", "f" and "c", respectively, then the formula $f=c-e$ will apply.

While the embodiment of the invention shown and described is fully capable of achieving the results desired, it is to be understood that this embodiment has been shown and described for purposes of illustration only and not for purposes of limitation. Other variations in the form and details that occur to those skilled in the art and which are within the spirit and scope of the invention are not specifically addressed. Therefore, the invention is limited only by the appended claims.

What is claimed is:

1. A calender, comprising:

a suspended spindle operatively attached at an upper end of an upright slide, wherein height-adjustable support-elements engage said suspended spindle, and a register and a primary support-element engage an upper end of said suspended spindle;

vertically-arranged rollers having an upper, lower and at least one center rollers positioned between said upper and lower rollers, wherein said upper roller is operatively attached to said upper end of said upright slide;

upper, lower and at least one center carrier-blocks operatively attached to said upper, lower and at least one center rollers, respectively, and slidably engaging said upright slide, wherein at least said lower and said at least one center carder-blocks are vertically movable along said slide, one of said carrier-blocks has a beating surface for positioning said primary support-element on said carrier-block, said height-adjustable support-elements support said upper, lower and at least one center carrier-blocks during separation of said upper, lower and at least one center rollers;

an adjustable carrier-nut operatively attached to said upper end of said suspended spindle and supported on said register;

an elevating-device operatively attached to said lower roller for elevating said lower roller, thereby engaging said at least one center roller and said upper roller;

a motor for driving said carrier-nut, said motor operatively attached to said carrier-nut at said upper end of said suspended spindle; and an insert positioned between said bearing-surface of said upper carrier-block and said primary support-element, wherein said insert has a thickness which allows said suspended spindle and said carrier-nut to be lifted during elevation of said upper carrier-block, wherein said carrier-nut can be easily rotated by said motor.

2. The calender of claim 1, wherein said insert is a horizontal slider seated on said upper carrier-block.

3. The calender of claim 1, wherein said bearing-surface is located on said upper carrier-block.

4. The calender of claim 1, wherein said upper roller is loaded by an energizer and is seated in said upper carrier-block, wherein said beating-surface is located on said upper carrier-block.

5. The calender of claim 1, wherein said upper and lower rollers are seated in said upper and lower carrier-blocks, respectively.

6. The calender of claim 1, wherein said at least one center roller is seated in at least one bearing-block and flexibly linked by a lever to said matching carrier-block, being provided with a stop to engage said lever.

* * * * *